US011441456B2

(12) United States Patent
Freeman et al.

(10) Patent No.: US 11,441,456 B2
(45) Date of Patent: Sep. 13, 2022

(54) TUNING A SOUND PROFILE OF A MUFFLER

(71) Applicant: TOYOTA MOTOR NORTH AMERICA, INC., Plano, TX (US)

(72) Inventors: Stephen E. Freeman, McKinney, TX (US); Tyler J. Kass, Ponder, TX (US)

(73) Assignee: TOYOTA MOTOR NORTH AMERICA, INC., Plano, TX (US)

( * ) Notice: Subject to any disclaimer, the term of this patent is extended or adjusted under 35 U.S.C. 154(b) by 535 days.

(21) Appl. No.: 16/458,875

(22) Filed: Jul. 1, 2019

(65) Prior Publication Data

US 2021/0003054 A1 Jan. 7, 2021

(51) Int. Cl.
*F01N 1/02* (2006.01)
*F01N 13/08* (2010.01)
*G10K 11/162* (2006.01)

(52) U.S. Cl.
CPC ..... *F01N 1/026* (2013.01); *F01N 13/082* (2013.01); *G10K 11/162* (2013.01)

(58) Field of Classification Search
CPC ..... G10K 11/162; F01N 13/082; F01N 1/026
USPC ..... 181/227, 228
See application file for complete search history.

(56) References Cited

U.S. PATENT DOCUMENTS 5,708,237 A 1/1998 Maeda et al.
6,598,390 B2 * 7/2003 Chang ..... F01N 1/006 181/227
6,769,511 B1 8/2004 Brooks et al.
6,915,876 B2 7/2005 Ciray
7,416,052 B2 * 8/2008 Mabuchi ..... F01N 1/084 181/227
7,610,993 B2 11/2009 Sullivan
8,220,587 B2 * 7/2012 Mori ..... F01N 13/1811 181/251
8,579,077 B2 * 11/2013 Ahn ..... F01N 13/08 181/256
8,851,231 B1 10/2014 Murphy
9,638,077 B2 * 5/2017 Horr ..... F01N 1/163
9,719,384 B2 * 8/2017 Nishioka ..... F01N 1/02
9,752,475 B2 * 9/2017 Peters ..... G10K 11/178
10,077,707 B2 * 9/2018 Le Roy ..... F04D 29/424
10,082,058 B2 9/2018 Creager et al.
2002/0033302 A1 * 3/2002 Kaneko ..... F01N 1/089 181/232

FOREIGN PATENT DOCUMENTS

KR 1020130051086 A 5/2013

* cited by examiner

*Primary Examiner* — Forrest M Phillips
(74) *Attorney, Agent, or Firm* — Haynes and Boone, LLP

(57) ABSTRACT

Apparatuses and methods for tuning a muffler. An apparatus comprises a housing for a muffler, a first inlet pipe, and a second inlet pipe. The housing includes a coupling chamber. The first inlet pipe has a first set of physical features and carries exhaust to the coupling chamber. The second inlet pipe has a second set of physical features and carries the exhaust to the coupling chamber. The first set of physical features varies from the second set of physical features with respect to at least one physical feature such that a first sound waveform passing through the first inlet pipe and a second sound waveform passing through the second inlet pipe are uniquely tuned to thereby tune an overall sound waveform emitted by the muffler.

20 Claims, 8 Drawing Sheets

TUNING A SOUND PROFILE OF A MUFFLER

FIELD

The present disclosure generally relates to tuning a sound profile of a muffler and, more particularly, to apparatuses, systems, and methods for tuning an overall sound profile of a muffler using inlets having different physical features such as, but not limited to, different lengths, diameters, or perforation patterns.

BACKGROUND

Mufflers are typically used in vehicles to reduce the noise emitted by engine exhaust systems in these vehicles. Some currently available mufflers include multiple inlets that feed into the muffler and one or more outlets that exit the muffler. For example, a muffler may have multiple inlets for multiple inlet pipes that extend through the muffler and to a coupling chamber within the muffler. Each of the inlet pipes has a sound profile formed by the corresponding sound waveform passing through that inlet pipe. These sound waveforms are coupled within the coupling chamber. The muffler may have an outlet pipe that extends from the coupling chamber to outside of the muffler to create an outlet for the muffler. In many cases, however, the sound waveform exiting through the outlet pipe of the muffler does not have a desired overall sound profile. For example, the sound emitted from the muffler may not have the desired quality or character.

SUMMARY

In one example embodiment, an apparatus comprises a housing for a muffler, a first inlet pipe, and a second inlet pipe. The housing includes a coupling chamber. The first inlet pipe has a first set of physical features and carries exhaust to the coupling chamber. The second inlet pipe has a second set of physical features and carries the exhaust to the coupling chamber. The first set of physical features varies from the second set of physical features with respect to at least one physical feature such that a first sound waveform passing through the first inlet pipe and a second sound waveform passing through the second inlet pipe are uniquely tuned to thereby tune an overall sound waveform emitted by the muffler.

In another example embodiment, a muffler comprises a housing, a first inlet pipe, a second inlet pipe, and an outlet pipe. The housing includes a coupling chamber. The first inlet pipe has a first set of physical features and carries exhaust to the coupling chamber. The second inlet pipe has a second set of physical features and carries exhaust to the coupling chamber. The outlet pipe carries the exhaust from the coupling chamber to an environment outside of the housing. The first set of physical features varies from the second set of physical features with respect to at least one physical feature such that a first sound waveform passing through the first inlet pipe and a second sound waveform passing through the second inlet pipe are uniquely tuned to thereby tune an overall sound waveform that passes through the outlet pipe.

In yet another example embodiment, a method for tuning inlet pipes of a muffler is provided. A first inlet pipe is formed for carrying exhaust to a coupling chamber within a housing of the muffler such that a first portion of the first inlet pipe has a first set of physical features. A second inlet pipes is formed for carrying the exhaust to the coupling chamber such that a second portion of the second inlet pipe has a second set of physical features. The first set of physical features varies from the second set of physical features with respect to at least one physical feature to configure the first inlet pipe and the second inlet pipe such that a first sound waveform that passes through the first inlet pipe and a second sound waveform that passes through the second inlet pipe are uniquely tuned to thereby tune an overall sound waveform emitted by the muffler.

It is to be understood that both the foregoing general description and the following detailed description are exemplary and explanatory in nature and are intended to provide an understanding of the present disclosure without limiting the scope of the present disclosure. In that regard, additional aspects, features, and advantages of the present disclosure will be apparent to one skilled in the art from the following detailed description.

BRIEF DESCRIPTION OF THE DRAWINGS

Aspects of the present disclosure are best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion. In addition, the present disclosure may repeat reference numerals, letters, or both in the various examples. This repetition is for the purpose of simplicity and clarity and does not in itself dictate a relationship between the various embodiments and/or configurations discussed.

DETAILED DESCRIPTION

Illustrative embodiments and related methods of the present disclosure are described below as they might be employed in one or more methods and systems for managing a supply of power to a communications system in a vehicle. In the interest of clarity, not all features of an actual implementation or method are described in this specification. It will of course be appreciated that in the development of any such actual embodiment, numerous implementation specific decisions must be made to achieve the developers' specific goals, such as compliance with system-related and business-related constraints, which will vary from one implementation to another. Moreover, it will be appreciated that such a development effort might be complex and time-consuming but would nevertheless be a routine undertaking for those of ordinary skill in the art having the benefit of this disclosure. Further aspects and advantages of the various embodiments and related methods of the disclosure will become apparent from consideration of the following description and drawings.

The example embodiments described below describe apparatuses, systems, and methods for tuning the sound waveforms of muffler inlet pipes prior to those sound waveforms being coupled within a coupling chamber of the muffler. This type of tuning provides a perceived improvement in the sound quality of character of the sound emitted from the muffler. This type of tuning may be achieved by, for example, varying at least one of the lengths, diameters, or perforation patterns of the portions of the inlet pipes that extend to the coupling chamber. In some cases, this type of tuning may be achieved using different absorption materials to wrap or surround these portions of the different inlet pipes.

In one or more example embodiments, an apparatus includes a housing for a muffler, a first inlet pipe, and a second inlet pipe. The housing includes a coupling chamber. The first inlet pipe has a first set of physical features and carries exhaust to the coupling chamber. The second inlet pipe has a second set of physical features and carries the exhaust to the coupling chamber. The first set of physical features varies from the second set of physical features with respect to at least one physical feature such that a first sound waveform passing through the first inlet pipe and a second sound waveform passing through the second inlet pipe are uniquely tuned to thereby tune an overall sound waveform emitted by the muffler.

Figure 1:
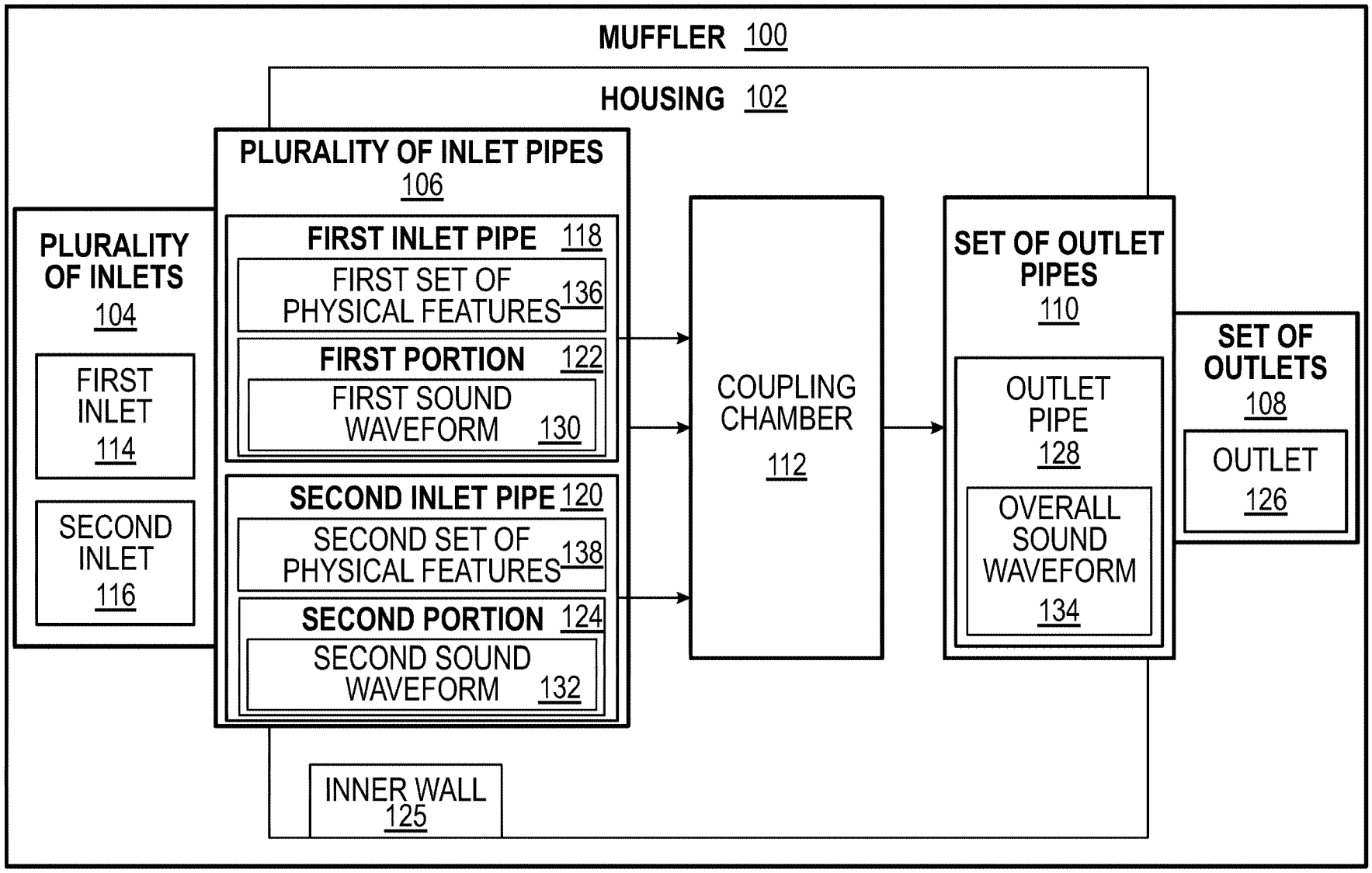
FIG. 1 is a block diagram of a muffler in accordance with an example embodiment.

Referring now to the figures, FIG. 1 is a block diagram depicting a muffler 100 in accordance with an example embodiment. Muffler 100 is an example of one type of muffler that may be used in the exhaust system of a vehicle, such as an automobile, a motorbike, or some other type of vehicle.

Muffler 100 includes housing 102, plurality of inlets 104, plurality of inlet pipes 106, set of outlets 108, and set of outlet pipes 110. As used herein, a "set of items" refers to one or more items. For example, set of outlets 108 and set of outlet pipes 110 may refer to one or more outlets and one or more outlet pipes, respectively.

Housing 102 includes coupling chamber 112 and may include one or more other chambers. Each of plurality of inlets 104 is formed at the opening of a corresponding one of plurality of inlet pipes 106 through which exhaust enters housing 102. In some example embodiments, at least one inlet pipe of plurality of inlet pipes 106 includes a portion that begins outside of housing 102 and a portion that extends within housing 102 to coupling chamber 112. In some examples, an inlet pipe of plurality of inlet pipes 106 may terminate or end just at coupling chamber 112 to allow the exhaust in the inlet pipe to enter coupling chamber 112. In other examples, the inlet pipe may extend into and through a portion of coupling chamber 112. In still other examples, the inlet pipe may extend through and out of coupling chamber 112 and into another chamber in housing 102, with the inlet pipe then curving or bending back into coupling chamber 112 to terminate or end within coupling chamber 112. In this manner, each of plurality of inlet pipes 106 may be implemented in any number of ways or configurations within housing 102.

Each of set of outlets 108 is formed at an opening of a corresponding one of set of outlet pipes 110 through which exhaust exits housing 102. Each of set of outlet pipes 110 carries exhaust from coupling chamber 112 to the environment outside of housing 102. In some example embodiments, at least a portion of an outlet pipe of set of outlet pipes 110 extends past housing 102.

In one or more embodiments, plurality of inlets 104 includes first inlet 114 and second inlet 116 and plurality of inlet pipes 106 includes first inlet pipe 118 and second inlet pipe 120. First inlet pipe 118 has first portion 122 and second inlet pipe 120 has second portion 124. In some embodiments, first portion 122 may be the entirety of first inlet pipe 118, second portion 124 may be the entirety of second inlet pipe 120, or both.

In some embodiments, first portion 122 of first inlet pipe 118 is the portion of first inlet pipe 118 that extends from inner wall 125 of housing 102 to coupling chamber 112. In some cases, first portion 122 includes the entire portion of first inlet pipe 118 extending from inner wall 125 of housing to the end (or termination) of first inlet pipe 118 at or within coupling chamber 112. In some embodiments, second portion 124 of second inlet pipe 120 is the portion of second inlet pipe 120 that extends from inner wall 125 of housing 102 to coupling chamber 112. In some cases, second portion 124 includes the entire portion of second inlet pipe 120 extending from inner wall 125 of housing to the end (or termination) of second inlet pipe 120 at or within coupling chamber 112. Set of outlets 108 may include outlet 126 and set of outlet pipes 110 may include outlet pipe 128.

In these embodiments, first inlet pipe 118 and second inlet pipe 120 may be tuned to improve the overall sound profile for muffler 100. The overall sound profile may be the overall sound quality, overall sound character, or both of the sound emitted by muffler 100. More specifically, the sound waveforms that pass through these inlet pipes may be tuned.

In one or more embodiments, first sound waveform 130 passing through first inlet pipe 118 and second sound waveform 132 passing through second inlet pipe 120 may be uniquely tuned to thereby tune overall sound waveform 134 emitted via outlet pipe 128 of muffler 100. For example, the sound quality or character of the sound produced by overall sound waveform 134 may be improved via tuning of the first sound waveform 130 and second sound waveform 132. This tuning may be with respect to at least one of the time domain or the frequency domain.

In these embodiments, first inlet pipe 118 has first set of physical features 136 that may be designed to tune first sound waveform 130. Second inlet pipe 120 has second set of physical features 138 that may be designed to tune second sound waveform 132. Each of first set of physical features 136 and second set of physical features 138 may include at least one of a length, a diameter, a perforation pattern, an absorption material, or some other type of physical feature.

In one or more embodiments, the "length" referred to for first inlet pipe 118 or second inlet pipe 120 is the length of first portion 122 or second portion 124, respectively. The "diameter" referred to for first inlet pipe 118 or second inlet pipe 120 may be the diameter of first portion 122 or second portion 124, respectively. In some cases, this diameter for first portion 122 or second portion 124 may be a constant diameter. In other cases, this diameter for first portion 122 or second portion 124 may vary along the length of that portion. The "perforation pattern" referred to for first inlet pipe 118 or second inlet pipe 120 may be the presence of perforations in some pattern along some portion of first portion 122 or second portion 124, respectively. The "absorption material" referred to for first inlet pipe 118 or second inlet pipe 120 may be the type of absorption material that is at least partially wrapped around or surrounding first portion 122 or second portion 124, respectively.

First set of physical features 136 and second set of physical features 138 vary with respect to at least one physical feature. For example, first set of physical features 136 and second set of physical features 138 may each include a same type of physical feature (e.g., length) but the value, quality, or style of that physical feature may be different. As another example, first set of physical features 136 may include a type of physical feature that second set of physical features 138 does not include, or vice versa. For example, first set of physical features 136 may include a perforation pattern, while second set of physical features 136 may not include a perforation pattern. In other words, first inlet pipe 118 may have a perforation pattern, while second inlet pipe 120 may not.

In this manner, first set of physical features 136 for first inlet pipe 118 and second set of physical features 138 for second inlet pipe 120 are selected to uniquely tune first inlet pipe 118 and second inlet pipe 120. More specifically, first inlet pipe 118 and second inlet pipe 120 are uniquely tuned via the difference or variation in the at least one physical feature between first set of physical features 136 and second set of physical features 138.

First set of physical features 136 and second set of physical features 138 may be varied between first inlet pipe 118 and second inlet pipe 120 to tune the interaction of the sound energy from each of these inlet pipes as the sound energy enters coupling chamber 112. This type of tuning varies first sound waveform 130 and second sound waveform 132 with respect to at least one of the time domain or the frequency domain such that coupling of these sound waveforms within coupling chamber 112 produces an overall desired sound quality or character.

For example, the tuning may be used to provide a certain type of pulsation of sound energy when the sound waveforms are coupled (e.g., summed, stacked, etc.). As another example, the tuning may be used to create a time delay between first sound waveform 130 and second sound waveform 132 to amplify target sound frequencies, cancel target frequencies, or both. First sound waveform 130 and second sound waveform 132 may be coupled by summation of these sound waveforms within coupling chamber 112 to form overall sound waveform 134.

Thus, in one or more embodiments, first portion 122 and second portion 124 may have different lengths. For example, first portion 122 may be longer than second portion 124. The increased length of first portion 122 as compared to second portion 124 increases the time of propagation of first sound waveform 130 through first portion 122 as compared to the propagation of second sound waveform 132 through second portion 124. In other words, first sound waveform 130 is time-delayed as compared to second sound waveform 132.

In some embodiments, first portion 122 and second portion 124 may have different diameters. For example, first portion 122 and second portion 124 may have different constant diameters. As another example, first portion 122 may have a diameter that is constant along its length while second portion 124 may have a diameter that varies along its length. In some cases, second portion 124 may have a first diameter that steps up to a larger diameter or steps down to a smaller diameter, while first portion 122 has a constant diameter. The "step" in diameter for second portion 124 may uniquely tune second sound waveform 132 propagating through second portion 124 with respect to at least the time domain.

In other embodiments, first portion 122 may have a perforation pattern and second portion 124 may have be solid without any perforation pattern. In some examples, first portion 122 and second portion 124 may have perforation patterns that differ with respect to each other. In some embodiments, first portion 122 may be at least partially wrapped in an absorption material, while second portion 124 may not be wrapped with any absorption material. In some examples, first portion 122 may be at least partially wrapped in an absorption material that is different in type from the absorption material that at least partially wraps or surrounds second portion 124. In still other embodiments, first portion 122 and second portion 124 may have both different lengths and different diameters. In some cases, first portion 122 and second portion 124 may have different diameters but the same perforation patterns.

In this manner, any combination of differences between first set of physical features 136 and second set of physical features 138 for first portion 122 and second portion 124, respectively, may be varied to provide the desired tuning of first inlet pipe 118 and second inlet pipe 120, respectively. Accordingly, first portion 122 of first inlet pipe 118 and second portion 124 of second inlet pipe 120 may be tuned in different ways to specifically design for the sound quality or sound character of the sound emitted by muffler 100.

Figure 2:
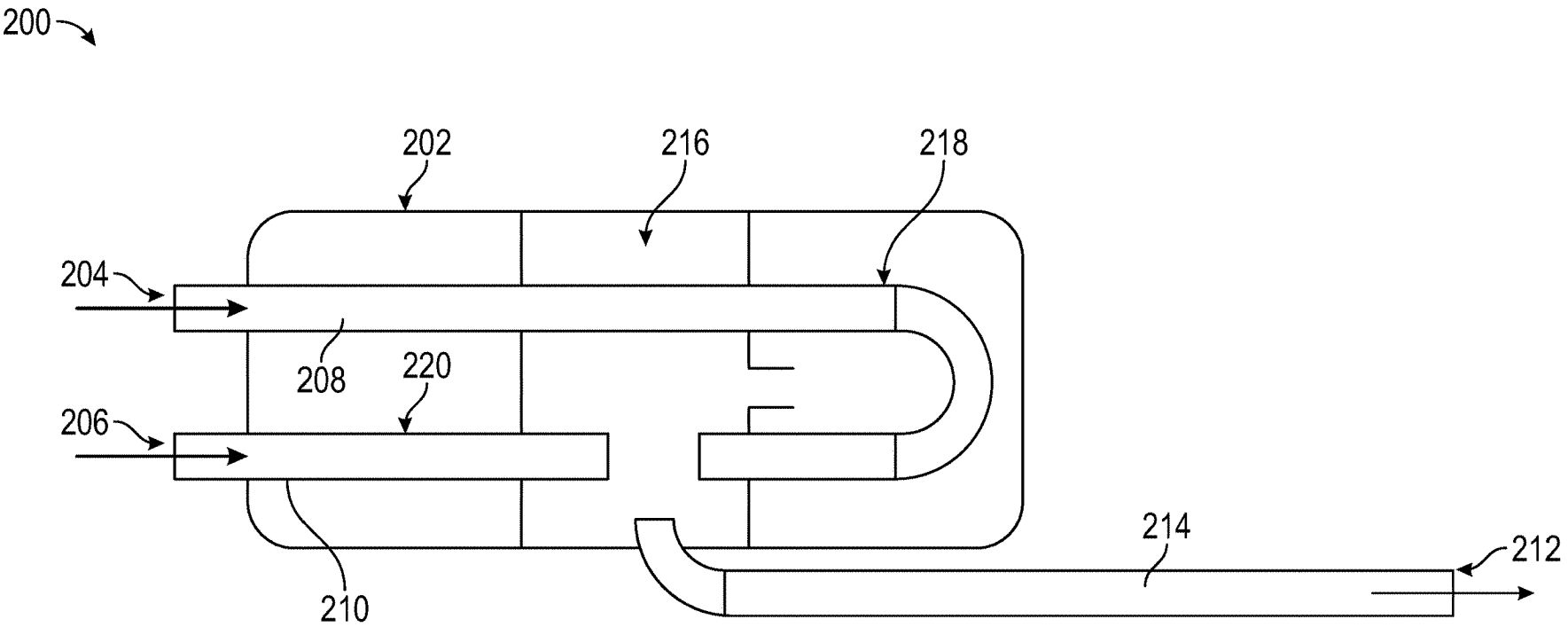
FIG. 2 is a schematic illustration of a muffler having inlet pipes tuned using different lengths in accordance with an example embodiment.

FIG. 2 is a schematic illustration of a muffler having inlet pipes tuned using different lengths in accordance with an example embodiment. Muffler 200 is an example of one implementation for muffler 100 in FIG. 1. Muffler 200 includes housing 202, first inlet 204, second inlet 206, first inlet pipe 208, second inlet pipe 210, outlet 212, and outlet pipe 214. Housing 202, first inlet 204, second inlet 206, first inlet pipe 208, second inlet pipe 210, outlet 212, and outlet pipe 214 are examples of implementations for housing 102, first inlet 114, second inlet 116, first inlet pipe 118, second inlet pipe 120, outlet 126, and outlet pipe 128, respectively, from in FIG. 1. As depicted, housing 202 includes coupling chamber 216, which is an example of one implementation for coupling chamber 112 in FIG. 1.

First inlet 204 and second inlet 206 are both positioned at a same end of muffler 200. First inlet pipe 208 carries exhaust from first inlet 204 to coupling chamber 216. Second inlet pipe 210 carries exhaust from second inlet 206 to coupling chamber 216. The sound waveforms that pass through each of first inlet pipe 208 and second inlet pipe 210 as exhaust moves through these inlet pipes are coupled (e.g., summed) in coupling chamber 216. The exhaust then moves from coupling chamber 216 and out of muffler 200 via outlet pipe 214. In the various embodiments, first inlet pipe 208 and second inlet pipe 210 are designed such that the sound waveforms carried through these inlet pipes are tuned to produce an overall sound waveform that passes through outlet pipe 214 having a desired overall sound profile. In other words, first inlet pipe 208 and second inlet pipe 210 are designed to ensure that the sound emitted from muffler 200 via outlet pipe 214 and outlet 212 has a desired sound quality or sound character.

In this embodiment, first inlet pipe 208 includes first portion 218 and second inlet pipe 210 includes second portion 220. First portion 218 and second portion 220 are examples of implementations for first portion 122 of first inlet pipe 118 and second portion 124 of second inlet pipe 120, respectively, in FIG. 1. First portion 218 and second portion 220 have different lengths. This varying of lengths provides a desired tuning with respect to the time domain for the sound waveforms carried by these portions of first inlet pipe 208 and second inlet pipe 210.

Figure 3:
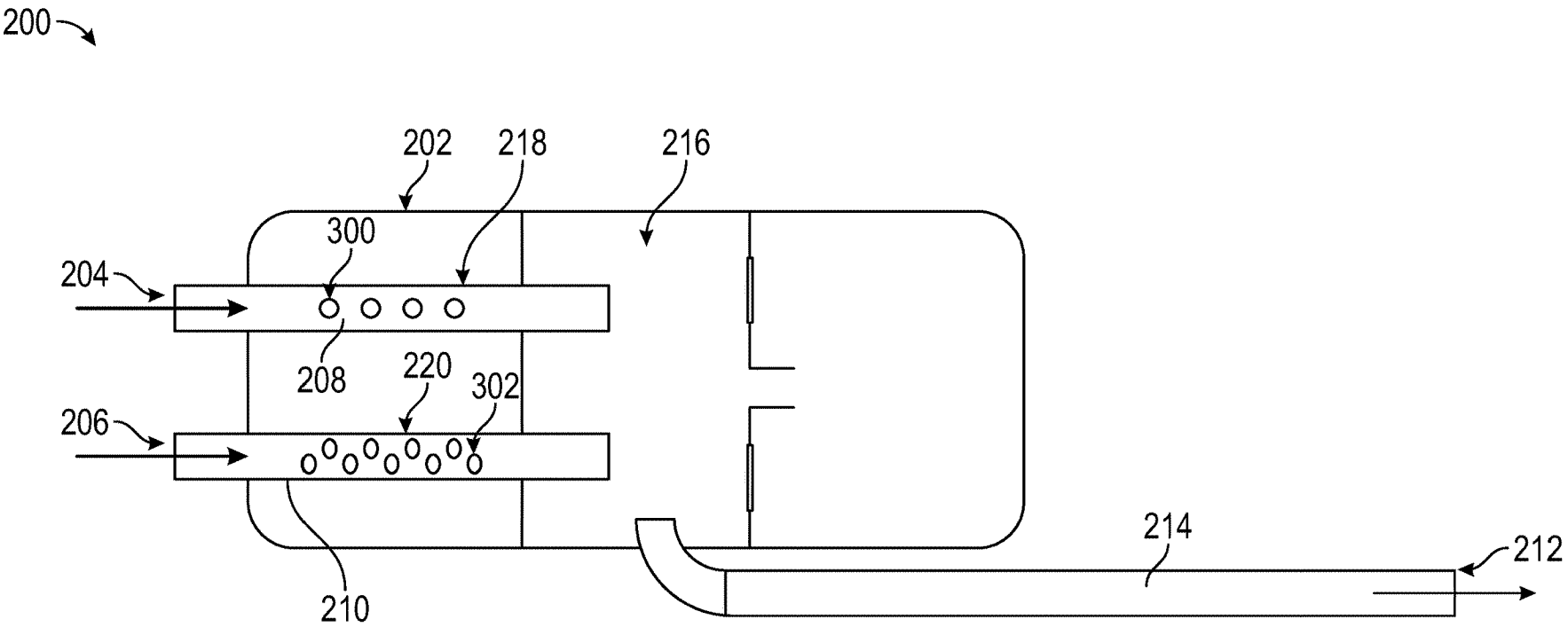
FIG. 3 is a schematic illustration of a muffler having inlet pipes tuned using different perforation patterns in accordance with an example embodiment.

FIG. 3 is a schematic illustration of muffler 200 having inlet pipes tuned using different perforation patterns in accordance with an example embodiment. In this embodiment, first inlet pipe 208 and second inlet pipe 210 of muffler 200 from FIG. 2 have varying perforation patterns. In particular, first portion 218 of first inlet pipe 208 has first perforation pattern 300 and second portion 220 of second inlet pipe 210 has second perforation pattern 302. First perforation pattern 300 is different from second perforation pattern 302. This difference in perforation patterns provides a desired tuning with respect to at least one of the time domain or the frequency domain for the sound waveforms carried by these portions of first inlet pipe 208 and second inlet pipe 210.

Figure 4:
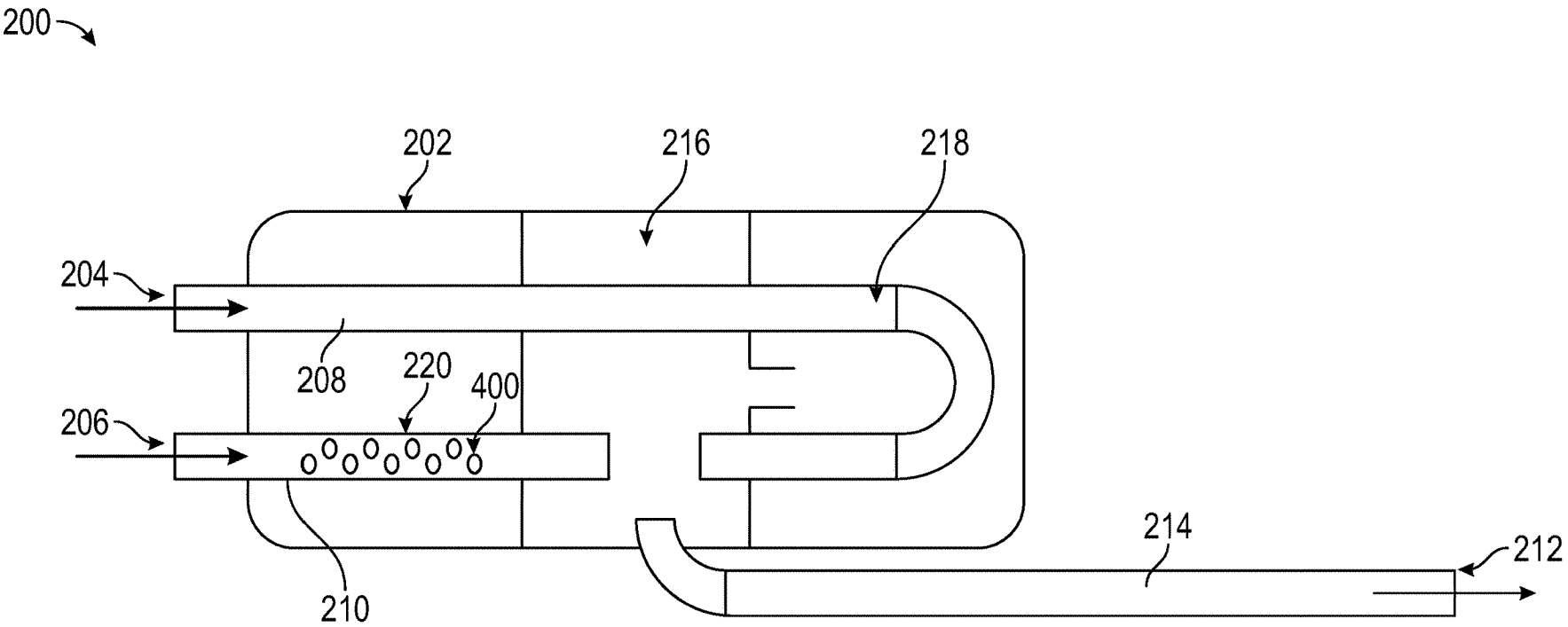
FIG. 4 is a schematic illustration of a muffler having inlet pipes tuned using different lengths and perforation patterns in accordance with an example embodiment.

FIG. 4 is a schematic illustration of muffler 200 having inlet pipes tuned using different lengths and perforation patterns in accordance with an example embodiment. In this embodiment, first portion 218 of first inlet pipe 208 and second portion 220 of second inlet pipe 210 vary in both length and perforation pattern. In particular, first portion 218 and second portion 222 have different lengths. Further, first portion 218 is solid and has no perforation pattern, while second portion 220 has perforation pattern 400. This variation in length and perforation pattern provides a desired tuning with respect to at least one of the time domain or the frequency domain for the sound waveforms carried by these portions of first inlet pipe 208 and second inlet pipe 210.

Figure 5:
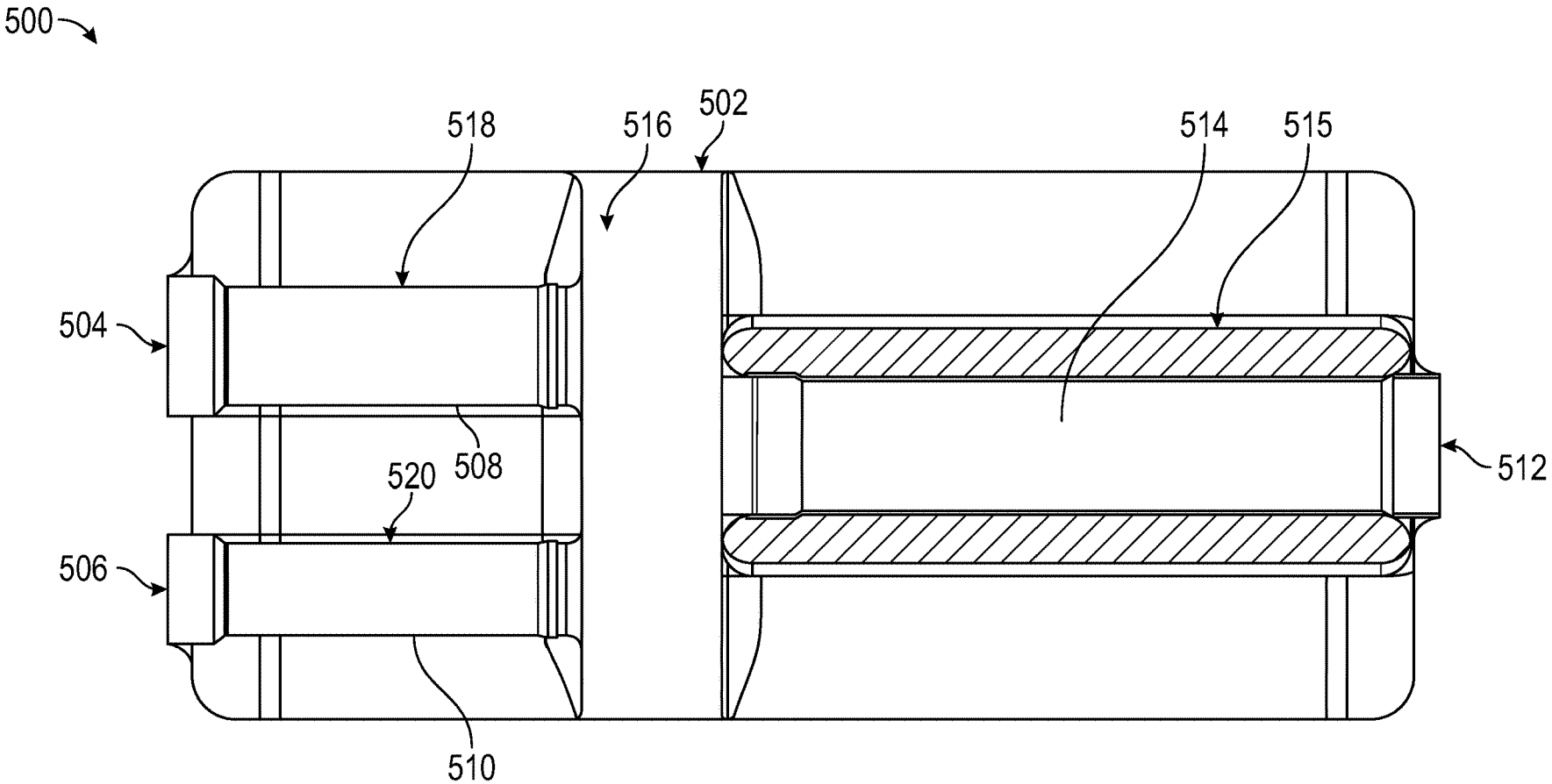
FIG. 5 is a schematic illustration of a muffler having inlet pipes tuned using different diameters in accordance with an example embodiment.

FIG. 5 is a schematic illustration of a different type of muffler having inlet pipes tuned using different diameters in accordance with an example embodiment. Muffler 500 is an example of one implementation for muffler 100 in FIG. 1. Muffler 500 includes housing 502, first inlet 504, second inlet 506, first inlet pipe 508, second inlet pipe 510, outlet 512, and outlet pipe 514. Housing 502, first inlet 504, second inlet 506, first inlet pipe 508, second inlet pipe 510, outlet 512, and outlet pipe 514 are examples of implementations for housing 102, first inlet 114, second inlet 116, first inlet pipe 118, second inlet pipe 120, outlet 126, and outlet pipe 128, respectively, from in FIG. 1.

Outlet pipe 514 has absorption material 515 wrapped around outlet pipe 514. In some cases, absorption material 515 is described as surrounding outlet pipe 514. Absorption material 515 helps absorb undesired noise as exhaust passes through outlet pipe 514 and out of outlet 512. As depicted, housing 502 includes coupling chamber 516, which is an example of one implementation for coupling chamber 112 in FIG. 1.

First inlet pipe 508 carries exhaust from first inlet 504 to coupling chamber 516. Second inlet pipe 510 carries exhaust from second inlet 506 to coupling chamber 516. The sound waveforms that pass through each of first inlet pipe 508 and second inlet pipe 510 as exhaust moves through these inlet pipes are coupled (e.g., summed) in coupling chamber 516. The exhaust then moves from coupling chamber 516 and out of muffler 500 via outlet pipe 514. In the various embodiments, first inlet pipe 508 and second inlet pipe 510 are designed such that the sound waveforms carried through these inlet pipes are tuned to produce an overall sound waveform that passes through outlet pipe 514 having a desired overall sound profile. In other words, first inlet pipe 508 and second inlet pipe 510 are designed to ensure that the sound emitted from muffler 500 via outlet pipe 514 and outlet 512 has a desired sound quality or sound character.

In this embodiment, first inlet pipe 508 includes first portion 518 and second inlet pipe 510 includes second portion 520. First portion 518 and second portion 520 are examples of implementations for first portion 122 of first inlet pipe 118 and second portion 124 of second inlet pipe 120, respectively, in FIG. 1. First portion 518 and second portion 520 have the same length but vary in diameter. This difference in diameter provides a desired tuning with respect to at least one of the time domain or the frequency domain for the sound waveforms carried by these portions of first inlet pipe 508 and second inlet pipe 510.

As illustrated, first portion 518 and second portion 520 both have constant diameters, with first portion 518 having a larger diameter than second portion 520. In other embodiments, first portion 518, second portion 520, or both may each have diameters that vary along the length of that portion.

Figure 6:
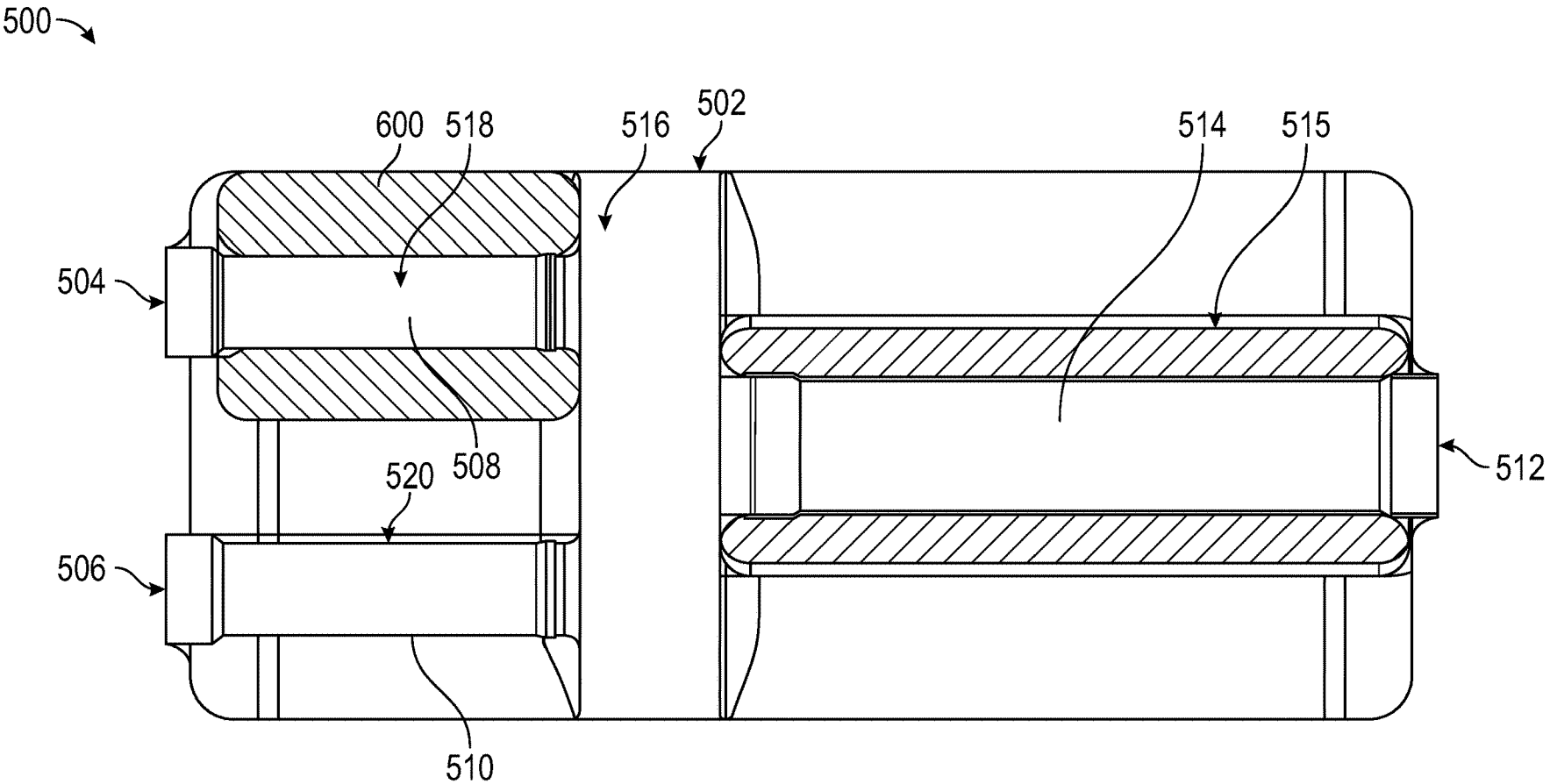
FIG. 6 is a schematic illustration of a muffler having inlet pipes tuned using different absorption materials in accordance with an example embodiment.

FIG. 6 is a schematic illustration of muffler 500 having inlet pipes tuned using different absorption materials in accordance with an example embodiment. In this embodiment, first portion 518 of first inlet pipe 508 is wrapped with or surrounded by absorption material 600, whereas second portion 520 of second inlet pipe 510 is not wrapped with or surrounded by an absorption material. Absorption material 600 helps absorb undesired noise as exhaust passes through first inlet pipe 508 into coupling chamber 516.

In other embodiments, first portion 518 and second portion 520 may both be wrapped with or surrounded by absorption materials but of different types. This type of variation in absorption material between first inlet pipe 508 and second inlet pipe 510 provides a desired tuning with respect to at least one of the time domain or the frequency domain for the sound waveforms carried by these portions of first inlet pipe 508 and second inlet pipe 510.

Figure 7:
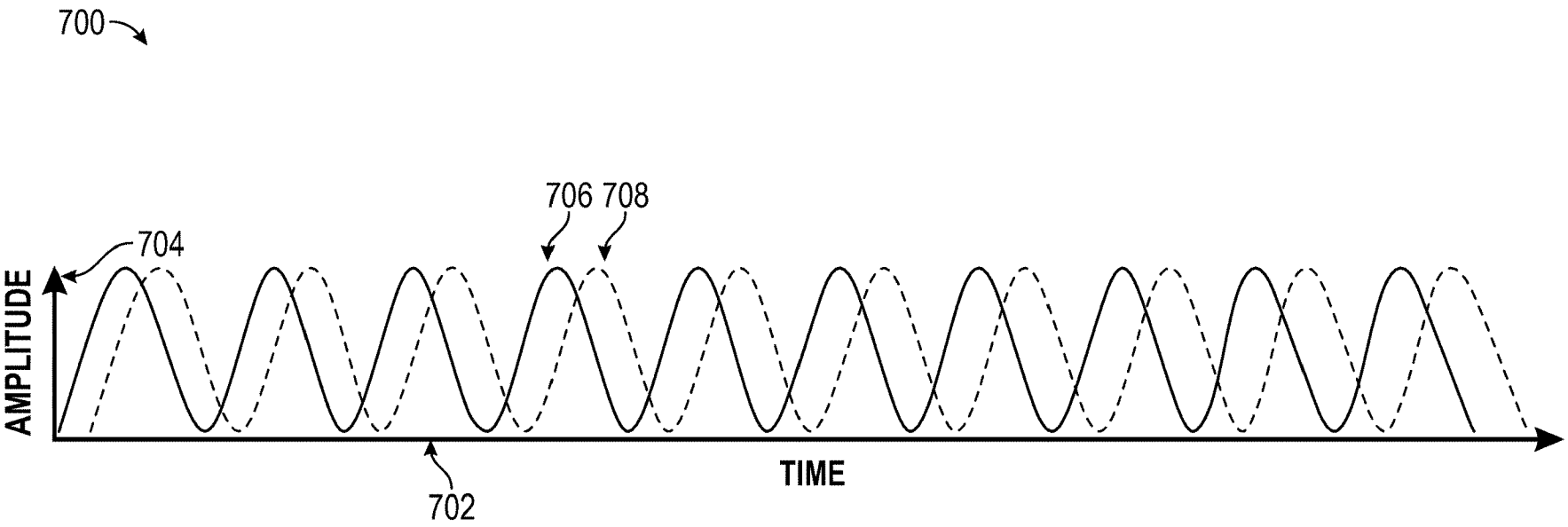
FIG. 7 is an illustration of sound waveforms produced by tuned inlets of a muffler in accordance with an example embodiment.

FIG. 7 is a chart illustration of sound waveforms tuned by inlet pipes of a muffler in accordance with an example embodiment. Chart 700 includes time axis 702 and amplitude axis 704. First waveform 706 represents the sound waveform passing through a first inlet pipe, such as first inlet pipe 118 in FIG. 1. Second waveform 708 represents the sound waveform passing through a second inlet pipe, such as second inlet pipe 120 in FIG. 1. As depicted, second waveform 708 is time-delayed with respect to first waveform 706.

This time delay is created by designing the physical features of the first inlet pipe and second inlet pipe to provide this type of tuning. For example, the time delay may be created by designing the physical features of the first inlet pipe and second inlet pipe such that the two sound waveforms are offset in time or phase to thereby amplify or cancel target frequencies. Length may be one physical feature used to create this time delay. Coupling of these waveforms within a coupling chamber of a muffler, such as coupling chamber 112 of muffler 100 in FIG. 1, results in overall sound waveform 134 emitted by muffler 100 having a desired sound quality or character.

Figure 8:
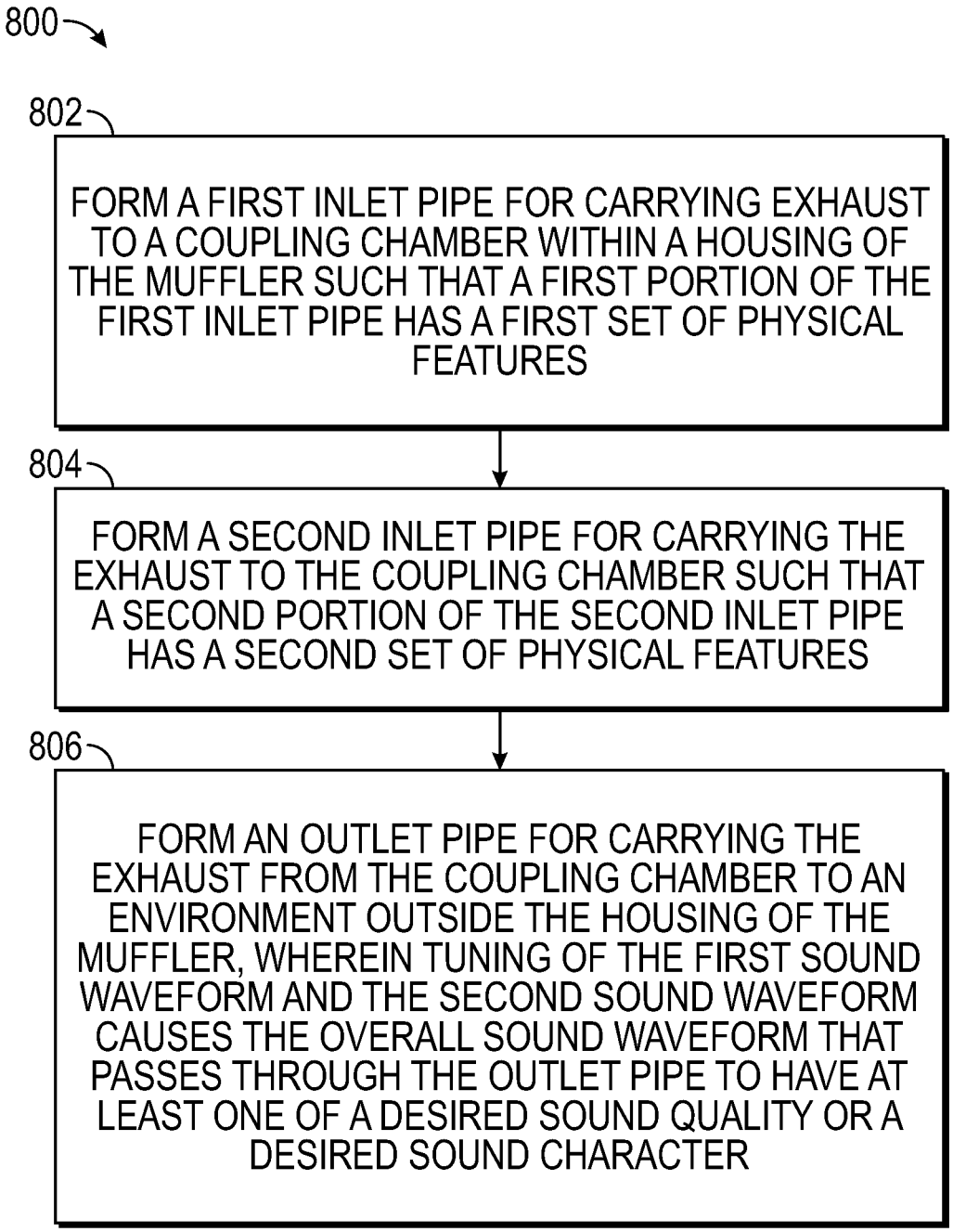
FIG. 8 is a flowchart of a method for forming a muffler having tuned inlets in accordance with an example embodiment.

FIG. 8 is a flowchart of a method 800 for turning inlet pipes of a muffler in accordance with an example embodiment. Method 800 is illustrated as a set of operations or steps 802 through 806 and is described with continuing reference to FIG. 1. One or more steps that are not expressly illustrated in FIG. 8 may be included before, after, in between, or as part of the steps 802 through 806. In some embodiments, one or more of the steps 802 through 806 may be implemented, at least in part, in the form of executable code stored on non-transitory, tangible, machine-readable media that when run by one or more processors may cause the one or more processors to perform one or more of the processes. In one or more embodiments, the steps 802 through 806 may be performed to tune plurality of inlet pipes 106 of muffler 100 from FIG. 1 during the manufacturing or production of muffler 100.

Method 800 may begin by forming first inlet pipe 118 for carrying exhaust to coupling chamber 112 within housing 102 of muffler 100 such that first portion 122 of first inlet pipe 118 has first set of physical features 136 (step 802). Second inlet pipe 120 is formed for carrying the exhaust to coupling chamber 112 such that second portion 124 of second inlet pipe 120 has second set of physical features 138 (step 804). First set of physical features 136 varies from second set of physical features 138 with respect to at least one physical feature to configure first inlet pipe 118 and second inlet pipe 120 such that first sound waveform 130 that passes through first inlet pipe 118 and second sound waveform 132 that passes through second inlet pipe 120 are uniquely tuned to thereby tune overall sound waveform 134 emitted by the muffler 100.

With respect to steps 802 and 804, first set of physical features 136 and second set of physical features 138 are varied between first inlet pipe 118 and second inlet pipe 120 to uniquely tune first sound waveform 130 and second sound waveform 132 with respect at least one of the time domain or the frequency domain to thereby tune overall sound waveform 134 emitted by muffler 100. First inlet pipe 118 and second inlet pipe 120 are formed such that at least one difference exists between first set of physical features 136 and second set of physical features 138. An outlet pipe is formed for carrying the exhaust from coupling chamber 112 to an environment outside housing 102 of muffler 100, wherein tuning of first sound waveform 130 and second sound waveform 132 causes overall sound waveform 134 that passes through the outlet pipe to have at least one of a desired sound quality or a desired sound character (step 806).

In one or more embodiments, first set of physical features 136 may include at least one of a length, a diameter, a perforation pattern, or an absorption material at least partially wrapped around first portion 122 of first inlet pipe 118 that is different from second portion 124 of second inlet pipe 120. Similarly, second set of physical features 138 may include at least one of a length, a diameter, a perforation pattern, or an absorption material at least partially wrapped around second portion 124 of second inlet pipe 120 that is different from first portion 122 of first inlet pipe 118.

In some embodiments, either first portion 122 or second portion 124 may have a perforation pattern, while the other one of first portion 122 or second portion 124 has no perforation pattern. In other embodiments, either first portion 122 or second portion 124 may have an absorption material at least partially wrapped around it, while the other one of first portion 122 or second portion 124 may have no absorption material wrapped around it.

In this manner, first inlet pipe 118 and second inlet pipe 120 may be configured in a number of different ways to tune the sound waveforms that pass through these inlet pipes prior to these sound waveforms being coupled in coupling chamber 112 of muffler 100. Overall sound waveform 134 is the summation of first sound waveform 130 and second sound waveform 132 within coupling chamber 112. This specialized tuning causes overall sound waveform 134 that passes through outlet pipe 128 to have at least one of a desired sound quality or a desired sound character. In other words, the overall perceived sound quality of character of the sound emitted by muffler 100 may be improved.

In this manner, the example embodiments described above provide various apparatuses, systems, and methods for easily tuning a muffler to improve the overall sound quality and character. The various example embodiments described above provide apparatuses and methods for designing a muffler to augment the combination of sound pressure waves from a multiple bank noise source to produce a perceived improvement in sound character.

In some embodiments, this tuning is provided via multiple inlet pipes having different lengths, different diameters, or both for the portions of these inlet pipes that extend to the coupling chamber within the housing of the muffler. These varying lengths and/or diameters help control when the sound waves passing through each of the inlet pipes expands within the housing. In other words, a time delay is created between the sound waveform passing through one inlet pipe as compared to the sound waveform passing through the other inlet pipe. This time delay augments the combination or coupling of acoustic energy from the inlet pipes allowing precise tuning of the summed overall sound waveform that exits the muffler via the outlet pipe.

In other embodiments, the inlet pipes may have a difference in perforation pattern. In particular, tuning may be provided via multiple inlet pipes having different perforation patterns along the bodies of these inlet pipes. For example, a muffler may have a first inlet pipe and a second inlet pipe in which the first inlet pipe has a perforation pattern and the second inlet pipe has either no perforation pattern or a different perforation pattern relative to the first inlet pipe. In some cases, both inlet pipes may have the same perforation pattern but different diameters. In still other embodiments, the inlet pipes may vary in absorption material surrounding the inlet pipes. For example, one inlet pipe may be wrapped in absorption material while the other inlet pipe is either not wrapped in any absorption material or is wrapped in a different type of absorption material.

In this manner, the inlet pipes of a muffler may be designed in various ways to tune the sound waveforms passing through these inlet pipes to thereby tune the overall sound profile of a muffler. In particular, this tuning helps control and improve the overall sound quality or character of the sound emitted from the muffler. The muffler may be designed to specifically amplify selected frequencies, cancel selected frequencies, or both by designing the inlet pipes with any difference or combination of differences in the physical features, as described above, of the inlet pipes.

Thus, a first inlet pipe and a second inlet pipe may be uniquely tuned by creating at least one difference or variation between their physical features. This tuning allows tuning of the sound waveforms passing through these inlet pipes with respect to at least one of the time domain or the frequency domain. For example, the sound waveform passing through a first inlet pipe may be uniquely tuned with respect to at least one of the time domain or the frequency domain in comparison to the sound waveform passing through a second inlet pipe. This tuning may be precisely designed such that the overall sound waveform emitted by the muffler after coupling of these two sound waveforms While certain exemplary embodiments of the invention have been described and shown in the accompanying drawings, it is to be understood that such embodiments are merely illustrative of and not restrictive on the broad invention, and that the embodiments of the invention not be limited to the specific constructions and arrangements shown and described, since various other modifications may occur to those ordinarily skilled in the art. The intention is to cover all modifications, equivalents and alternatives falling within the spirit and scope of the disclosure as defined by the claims.

What is claimed is:

1. An apparatus comprising:

a housing for a muffler, the housing including a coupling chamber;

a first inlet pipe having a first set of physical features, wherein the first inlet pipe opens into the coupling chamber to carry exhaust to the coupling chamber;

a second inlet pipe having a second set of physical features, wherein the second inlet pipe opens into the coupling chamber to carry the exhaust to the coupling chamber; and an outlet pipe having a first end that opens into the coupling chamber to receive the exhaust from the coupling chamber, wherein the outlet pipe extends from the first end within the coupling chamber to a second end in an environment outside of the housing, wherein the first set of physical features varies from the second set of physical features with respect to at least one physical feature such that a first sound waveform passing through the first inlet pipe and a second sound waveform passing through the second inlet pipe are uniquely tuned to thereby tune an overall sound waveform emitted by the muffler.

2. The apparatus of claim 1, wherein the first sound waveform and the second sound waveform are uniquely tuned with respect to a time domain by a first portion of the first inlet pipe and a second portion of the second inlet pipe that extend through the housing and to the coupling chamber having different lengths.

3. The apparatus of claim 1, wherein the first sound waveform and the second sound waveform are uniquely tuned by a first portion of the first inlet pipe and a second portion of the second inlet pipe that extend through the housing and to the coupling chamber having different diameters.

4. The apparatus of claim 1, wherein the first sound waveform and the second sound waveform are uniquely tuned by a first portion of the first inlet pipe and a second portion of the second inlet pipe that extend through the housing and to the coupling chamber having different perforation patterns.

5. The apparatus of claim 1, wherein the first sound waveform and the second sound waveform are uniquely tuned by either a first portion of the first inlet pipe that extends through the housing and to the coupling chamber or a second portion of the second inlet pipe that extends through the housing and to the coupling chamber having a perforation pattern.

6. The apparatus of claim 1, wherein the first sound waveform and the second sound waveform are uniquely tuned by a first portion of the first inlet pipe and a second portion of the second inlet pipe that extend through the housing and to the coupling chamber being at least partially covered by different types of absorption materials.

7. The apparatus of claim 1, wherein the first sound waveform and the second sound waveform are uniquely tuned by either a first portion of the first inlet pipe that extends through the housing and to the coupling chamber or a second portion of the second inlet pipe that extends through the housing and to the coupling chamber being at least partially surrounded by an absorption material.

8. The apparatus of claim 1, wherein the outlet pipe extends from the coupling chamber to the environment outside of the housing and through which the overall sound waveform is emitted from the muffler, wherein the overall sound waveform is formed by a summation of the first sound waveform and the second sound waveform.

9. The apparatus of claim 1, wherein the outlet pipe extends from the coupling chamber, through the housing, to the environment outside of the housing and through which the overall sound waveform is emitted from the muffler, wherein the overall sound waveform is formed by a summation of the first sound waveform and the second sound waveform.

10. The apparatus of claim 1 further comprising:

a plurality of outlet pipes that extend from the coupling chamber to outside of the housing.

11. A muffler comprising:

a housing that includes a coupling chamber;

a first inlet pipe having a first set of physical features, wherein the first inlet pipe opens into the coupling chamber to carry exhaust to the coupling chamber;

a second inlet pipe having a second set of physical features, wherein the second inlet pipe carries exhaust to the coupling chamber; and an outlet pipe having a first end that opens into the coupling chamber to receive the exhaust from the coupling chamber, wherein the outlet pipe extends from the first end within the coupling chamber to a second end in an environment outside of the housing and that carries the exhaust from the coupling chamber to an environment outside of the housing;

wherein the first set of physical features varies from the second set of physical features with respect to at least one physical feature such that a first sound waveform passing through the first inlet pipe and a second sound waveform passing through the second inlet pipe are uniquely tuned to thereby tune an overall sound waveform that passes through the outlet pipe.

12. The muffler of claim 11, wherein the first sound waveform and the second sound waveform are uniquely tuned with respect to at least one of the time domain or the frequency domain by varying at least one of a length, a diameter, a perforation pattern, or an absorption material between a first portion of the first inlet pipe and a second portion of the second inlet pipe.

13. A method for tuning inlet pipes of a muffler, the method comprising:

forming a first inlet pipe that opens into a coupling chamber and carries exhaust to the coupling chamber within a housing of the muffler such that a first portion of the first inlet pipe has a first set of physical features; and forming a second inlet pipe that opens into the coupling chamber and carries exhaust to the coupling chamber such that a second portion of the second inlet pipe has a second set of physical features; and forming an outlet pipe having a first end that opens into the coupling chamber to receive the exhaust from the coupling chamber, wherein the outlet pipe extends from the first end within the coupling chamber to a second end in an environment outside of the housing, wherein the first set of physical features varies from the second set of physical features with respect to at least one physical feature to configure the first inlet pipe and the second inlet pipe such that a first sound waveform that passes through the first inlet pipe and a second sound waveform that passes through the second inlet pipe are uniquely tuned to thereby tune an overall sound waveform emitted by the muffler.

14. The method of claim 13, wherein forming the first inlet pipe comprises:

forming the first inlet pipe such that the first portion of the first inlet pipe has at least one of a different length, diameter, perforation pattern, or absorption material at least partially wrapped around the first portion of the first inlet pipe as compared to the second portion of the second inlet pipe.

15. The method of claim 13, wherein forming the second inlet pipe comprises:

forming the second inlet pipe such that the second portion of the second inlet pipe has at least one of a different length, diameter, perforation pattern, or absorption material at least partially wrapped around the second portion of the second inlet pipe as compared to the first portion of the first inlet pipe.

16. The method of claim 13, wherein forming the first inlet pipe comprises:

forming the first inlet pipe such that the first portion has a perforation pattern; and wherein forming the second inlet pipe comprises:

forming the second inlet pipe such that the second portion has no perforation pattern.

17. The method of claim 13, wherein forming the first inlet pipe comprises:

forming the first inlet pipe such that the first portion has no perforation pattern; and wherein forming the second inlet pipe comprises:

forming the second inlet pipe such that the second portion has a perforation pattern.

18. The method of claim 13, wherein forming the first inlet pipe comprises:

forming the first inlet pipe such that the first portion has an absorption material at least partially wrapped around the first portion; and wherein forming the second inlet pipe comprises:

forming the second inlet pipe such that the second portion has no absorption material wrapped around the second portion.

19. The method of claim 13, wherein forming the first inlet pipe comprises:

forming the first inlet pipe such that the first portion has no absorption material wrapped around the first portion; and wherein forming the second inlet pipe comprises:

forming the second inlet pipe such that the second portion has an absorption material at least partially wrapped around the second portion.

20. The method of claim 13, wherein tuning of the first sound waveform and the second sound waveform causes the overall sound waveform that passes through the outlet pipe to have at least one of a desired sound quality or a desired sound character.

* * * * *